United States Patent [19]

Jäggle et al.

[11] 4,391,252

[45] Jul. 5, 1983

[54] FUEL INJECTION SYSTEM

[75] Inventors: Günther Jäggle, Stuttgart; Klaus-Jürgen Peters, Affalterbach; Klaus Riel, Möglingen, all of Fed. Rep. of Germany

[73] Assignee: Robert Bosch GmbH, Stuttgart, Fed. Rep. of Germany

[21] Appl. No.: 270,210

[22] Filed: Jun. 3, 1981

[30] Foreign Application Priority Data

Jun. 7, 1980 [DE] Fed. Rep. of Germany ..... 3021561

[51] Int. Cl.[3] ..... F02M 39/00

[52] U.S. Cl. ..... 123/454; 123/452; 123/463

[58] Field of Search ..... 123/454, 455, 452, 453, 123/383, 463, 505

[56] References Cited

U.S. PATENT DOCUMENTS

| | | | |
|---|---|---|---|
| 2,330,650 | 9/1943 | Weiche | 123/463 |
| 3,994,267 | 11/1976 | Eisele et al. | 123/454 |
| 4,090,487 | 5/1978 | Stumpp et al. | 123/452 |
| 4,112,900 | 9/1978 | Schwartz et al. | 123/455 |
| 4,132,195 | 1/1979 | Bianchi et al. | 123/454 |
| 4,284,048 | 8/1981 | Schelhas | 123/454 |

FOREIGN PATENT DOCUMENTS

| | | | |
|---|---|---|---|
| 2800613 | 7/1979 | Fed. Rep. of Germany | 123/454 |

*Primary Examiner*—Charles J. Myhre
*Assistant Examiner*—Magdalen Moy
*Attorney, Agent, or Firm*—Edwin E. Greigg

[57] ABSTRACT

A fuel injection system for supercharged internal combustion engines is proposed, which serves to meter a quantity of fuel adapted to the quantity of air aspirated by the engine and also serves to regulate the fuel-air mixture in accordance with operating characteristics of the engine. The fuel injection system includes an air flow rate member, the restoring force of which is generated by means of pressure fluid in a control pressure line. The pressure of the pressure fluid in the control pressure line is variable in accordance with at least one pressure control valve, by means of which the pressure in the control line and thus the restoring force exerted upon the air flow rate member, which actuates a control slide of a metering and distribution valve assembly, can be reduced when the intake tube pressure downstream of a compressor increases. The result is that an undesirable leaning down of the fuel-air mixture caused by the error in air density can be corrected.

5 Claims, 2 Drawing Figures

FUEL INJECTION SYSTEM

BACKGROUND OF THE INVENTION

The invention relates to a fuel injection system for compressor-equipped internal combustion engines. In a known fuel injection system, the pressure drop at the fuel metering valve is variable in accordance with the charge air pressure, in order to correct the fuel-air ratio, which in internal combustion engines with supercharging becomes leaner as the air density increases.

OBJECT AND SUMMARY OF THE INVENTION

The fuel injection system according to the invention has the advantage that adulteration of the fuel-air ratio caused by the variation of air density in supercharged engines is corrected in a simple manner.

The invention will be better understood and further objects and advantages thereof will become more apparent from the ensuing detailed description of two preferred embodiments taken in conjunction with the drawings.

DESCRIPTION OF THE PREFERRED EMBODIMENT

Figure 1:
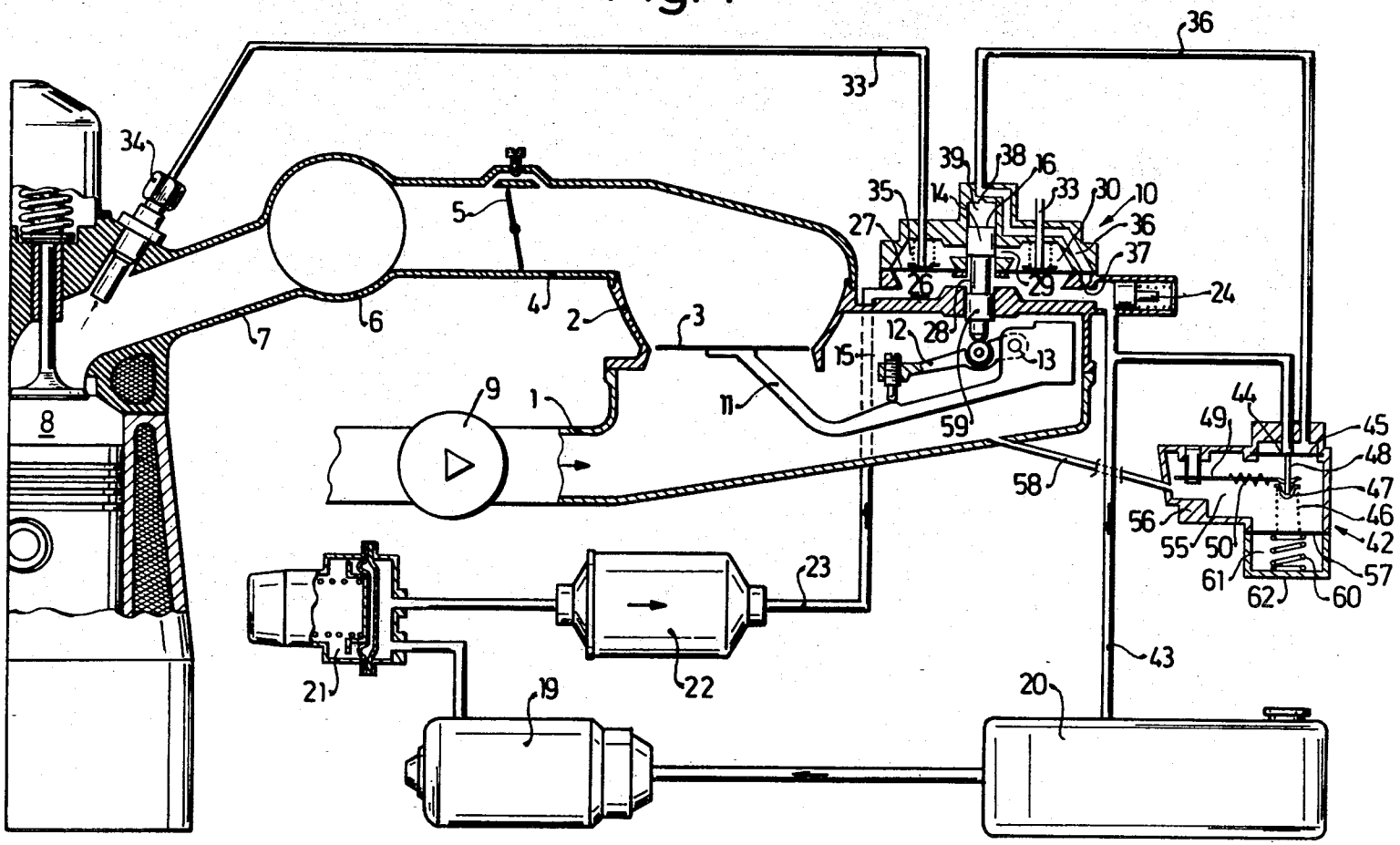
FIG. 1 shows a fuel injection system having a first exemplary embodiment of a pressure control valve.

In FIG. 1, a fuel injection system is shown which includes an intake manifold 1 having a conical section 2 which contains an air flow rate member 3, beyond which there is located an intake tube region 4 containing an arbitrarily settable throttle valve 5. Aspirated air flows through the intake tube in the direction of the arrow to a manifold 6, from which it is directed via an individual intake tube region 7 to one or more cylinders 8 of a mixture-compressing internal combustion engine with externally-supplied ignition.

In the present case, the air flow rate member 3 is a baffle plate disposed transversely with respect to the direction of air flow and capable of displacement within the conical region 2 of the intake tube, for example as an approximately linear function of the air flow rate through the tube. The air pressure between the air flow rate member 3 and the throttle valve 5 will be constant, provided that the restoring force acting on the air flow rate member 3 is constant and that the air pressure ahead of the member 3 is also constant. Upstream of the air flow rate member 3, a known compressor 9 (turbocharger) which compresses the air supplied to the engine is disposed in the intake tube. The function of this known element accordingly need not be described herein. The air flow rate member 3 controls the opening of a metering and distribution valve assembly 10. The motion of the air flow rate member 3 is transmitted by an operating lever 11, which is pivoted on the same shaft as a correction lever 12 and which actuates the control slide 14, which is the movable member of the metering and distribution valve assembly 10. A mixture control screw 15 permits an adjustment of the desired fuel-air mixture. The end face 16 of the control slide 14 remote from the lever 11 experiences the pressure of a control fluid, which is exerted upon the air flow rate member 3 and acts as a return force in opposition to the force of the flowing air.

Fuel is supplied by an electric fuel pump 19, which aspirates fuel from a fuel tank 20 and delivers it through a storage container 21, a filter 22 and a fuel line 23 to the fuel metering and distribution assembly 10. A system pressure regulator 24 keeps the fuel injection system pressure constant.

The fuel supply line 23 splits into several branches which lead to chambers 26 of the fuel valve assembly 10. One side of a diaphragm 27 in each chamber is affected by fuel pressure. The chambers 26 also communicate with an annular groove 28 of the control slide 14. Depending on the axial position of the control slide 14, the annular groove 28 opens control slits 29 to varying degrees, each leading to one chamber 30 which is divided from the chamber 26 by the diaphragm 27. From the chambers 30, fuel flows through the injection channels 33 to the individual injection valves 34, which are located in the vicinity of the engine cylinders 8 in the intake tube region 7. The diaphragm 27 is the movable valve member of a flat seat valve which is held open by a spring 35 whenever the fuel injection system is not operating. The diaphragm boxes, defined in each case by a chamber 26 and a chamber 30, insure that the pressure drop at the metering valve 28, 29 is substantially constant, independently of the amount of overlap existing between the annular groove 28 and the control slits 29, or in other words independently of the fuel quantity flowing to the injection valves 34. This insures that the metered-out fuel is exactly proportional to the control path of the slide 14.

During a pivoting displacement of the operating lever 11, the air flow rate member 3 is moved into the conical region 2 so that the varying annular cross section between the flow rate member and the conical wall remains proportional to the displacement of the air flow rate member The force which generates the restoring force on the control slide 14 is a pressurized fluid, which, in this case, is fuel. To provide this fluid, a control pressure line 36 branches off from the main fuel supply line 23 via a decoupling throttle 37. The control pressure line 36 communicates via a damping throttle 38 with a pressure chamber 39 and into which one end face 16 of the control slide 14 protrudes.

The control pressure line 36 contains a control pressure valve 42, which permits control fluid to return to the fuel tank 20 via a return line 43 without pressure. One function of the control pressure valve 42 shown herein is to change the pressure, which produces the restoring force during the warm-up of the engine, in accordance with time and temperature.

The control pressure valve 42 is a flat-seat valve having a fixed valve seat 44 and a diaphragm 45 acting as the movable valve element, which is urged in the closing direction by a compression spring 46. The compression spring 46 acts via a spring support 47 and a transmission pin 48 upon the diaphragm 45. When the engine temperature is below the normal operating temperature, a bimetallic spring 49 acts in opposition to the force of the compression spring 46. The bimetallic spring 49 carries an electric heating element 50, the operation of which after starting causes a diminution of the force of the bimetallic spring 49 on the compression spring 46, and by this means the control pressure in the control pressure line 36 increases.

The spring chamber 55, which is defined by the housing 56 and the diaphragm 45, and on the other side by a correcting diaphragm 57 embodied as a yielding wall, communicates via an air line 58 with the intake tube section 1 between the compressor 9 and the air flow rate member 3. As a result, it is assured that the effect of the intake tube pressure in the intake tube section 1 upon the end face 59 on the air side, which protrudes from the metering and distribution valve assembly 10, is countered by a compensating force on the end face 16 of the control slide 14. As a result of the compression by the compressor 9 of the air aspirated by the engine, an excessively small fuel quantity is metered at the metering and distribution valve assembly 10, resulting in an excessively lean fuel-air mixture. In order to correct this error caused by the increased air density of the aspirated air, it is therefore necessary to reduce the pressure of the fuel in the control pressure line 36 in accordance with the intake tube pressure in the intake tube section 1 downstream of the compressor 9; as a result, the restoring force on the air flow rate member 3 is reduced, and a larger quantity of fuel is metered. A reduction of the fuel pressure in the control pressure line 36 may be effected in that with increasing intake tube pressure in the intake tube section 1 downstream of the compressor 9, the closing force of the compression spring 46 on the diaphragm 45 is decreased. A correcting spring 60 is supported on the face of the correcting diaphragm 57 remote from the spring chamber 55. The correcting spring 60 is disposed in an atmospheric chamber 61 which communicates with the atmosphere via an opening 62. The intake tube pressure 1 downstream of the compressor 9 is in a non-linear proportion to the correct, set-point pressure of the fuel in the control pressure line 36. When a suitable spring stiffness is selected for the compression spring 46 and the correcting spring 60 and when the cross sections of the diaphragm 45 and of the correcting diaphragm 57 are suitably selected, the described embodiment of the pressure control valve 42 enables a linear correction of the fuel pressure in the control pressure line in accordance with the intake tube pressure 1 downstream of the compressor 9. The result, for two arbitrarily selectable intake tube pressures 1, is a precise adaptation of the set-point pressure of the fuel in the control pressure line 36. As a result of this arrangement, the fuel-air mixture is held substantially constant even when the intake tube pressure 1 (charge pressure) is increasing.

Figure 2:
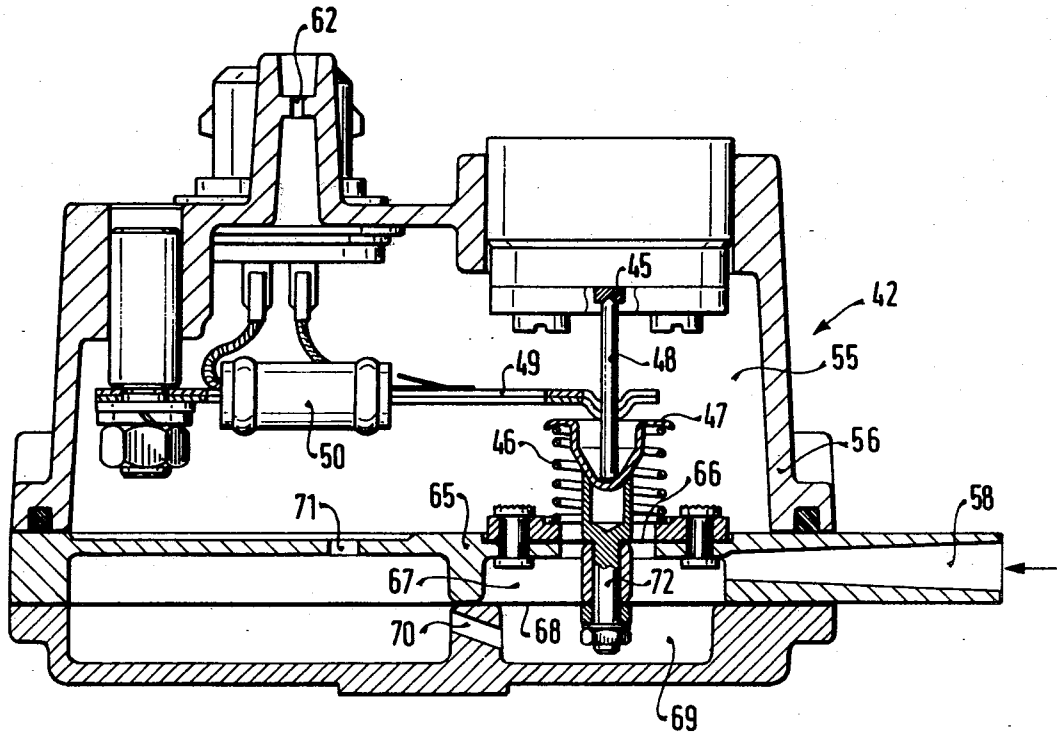
FIG. 2 shows a second exemplary embodiment of a pressure control valve.

A second exemplary embodiment of a pressure control valve 42 for correction of the fuel-air mixture in accordance with the intake tube pressure 1 downstream of the compressor 9 is illustrated in FIG. 2. The elements which remain the same as those of the exemplary embodiment shown in FIG. 1 are given identical reference numerals. In this second exemplary embodiment, the compression spring 46 is supported with its end remote from the spring plate 47 on a bottom 65 of the housing 56 in such a manner that it is attached to the housing. A decoupling diaphragm 66 is also secured on this bottom 65 of the housing 56 and separates the spring chamber 55 which communicates via the opening 62 with the atmosphere from a work chamber 67 communicating via the air line 58 with the intake tube pressure 1 downstream of the compressor 9. The work chamber 67 is defined on the other side by a work diaphragm 68, which separates the work chamber 67 from a lower chamber 69. This lower chamber 69 communicates via openings 70 and 71 with the spring chamber 55; in other words, atmospheric pressure prevails in it. The decoupling diaphragm 66 and the work diaphragm 68 are firmly connected in their respective central areas with an actuation element 72, which is rigidly connected in turn with the spring plate 47. The cross sections of the decoupling diaphragm 66 and the work diaphragm 68 are appropriately adapted to one another in accordance with the desired correction; specifically, this adaptation is such that the effective cross section of the work diaphragm 68 is larger than the effective cross section of the decoupling diaphragm 66. The ratio between these surface areas may by way of example be approximately 3:1. Thus if the intake tube pressure 1 downstream of the compressor 9, and accordingly the pressure in the work chamber 67, increases, then in consequence the pressure force resulting from the pressure forces engaging the diaphragms 66, 68 decreases the closing force exerted by the compression spring 46 upon the diaphragm 45, so that the fuel pressure in the control pressure line 36 is reduced. This reduction of the control pressure counteracts the leaning down of the mixture, which would otherwise result from the increased air density in the intake tube 1, in such a manner that the mixture composition remains substantially constant.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A fuel injection system for compressor-equipped internal combustion engines having injection into an intake tube, in which a flow rate member and an arbitrarily actuatable throttle valve are disposed in sequence downstream of a compressor, the flow rate member being movable counter to a restoring force in accordance with a quantity of air flowing therethrough, and a valve disposed in a fuel supply line having a movable element for metering a fuel quantity corresponding to the quantity of air, characterized in that said restoring force is generated by means of pressure fluid, which is exerted continuously upon a control slide under a constant but arbitrarily variable pressure supplied by a control pressure line, said restoring force, and the variation of the pressure of the pressure fluid being effected by means of at least one pressure control valve controllable in accordance with engine characteristics, further wherein said pressure control valve includes a movable valve element upon which a compression spring acts in the closing direction of the pressure control valve, the force of said spring exerted upon the movable valve element being capable of reduction with increasing intake tube pressure downstream of said compressor.

2. A fuel injection system as defined by claim 1, characterized in that said compression spring is supported on one end remote from said movable valve element on a yielding wall, which separates a spring chamber located between said movable valve element and said yielding wall and communicating with the intake tube pressure downstream of said compressor from an atmospheric chamber arranged to communicate with the atmosphere, further wherein a correcting spring, which is supported at one end on said yielding wall is disposed in said atmospheric chamber.

3. A fuel injection system as defined by claim 2, characterized in that said movable valve element and said yielding wall are embodied as diaphragm means.

4. A fuel injection system as defined in claim 1, characterized in that said compression spring is disposed in a spring chamber and is supported on one end on a housing confining said pressure control valve and on the other end on a spring plate, further wherein an actuation element which is engaged by a decoupling diaphragm which separates the spring chamber which communicates with the atmosphere from a work chamber which communicates with the intake tube pressure downstream of the compressor is connected with said spring plate and further wherein said work chamber is defined on the other side relative to the atmosphere by a work diaphragm which is also connected with said actuation element, the effective cross section of said work diaphragm being larger than the effective cross section of said decoupling diaphragm.

5. A fuel injection system as defined by claim 2 or 4, characterized in that said compression spring engages a spring plate on which an actuation pin is supported, said actuation pin arranged to rest on its other end on the movable valve element, and further wherein a bimetallic spring is in cooperative communication with said spring plate in such a manner that as temperatures decrease, said bimetallic spring counteracts the force of said compression spring.

* * * * *